United States Patent [19]

Ramsauer

[11] Patent Number: 4,998,757

[45] Date of Patent: Mar. 12, 1991

[54] BAR ENCLOSURE FOR SHEET METAL CABINET DOORS

[76] Inventor: Dieter Ramsauer, Am Neuhauskothen 20, D-5620 Velbert 11, Fed. Rep. of Germany

[21] Appl. No.: 214,731

[22] PCT Filed: Sep. 12, 1987

[86] PCT No.: PCT/DE87/00413

§ 371 Date: May 25, 1988

§ 102(e) Date: May 25, 1988

[30] Foreign Application Priority Data

Sep. 25, 1986 [DE] Fed. Rep. of Germany ..... 86113173

[51] Int. Cl.[5] ..... E05C 9/12

[52] U.S. Cl. ..... 292/39; 292/160; 292/DIG. 68

[58] Field of Search ..... 292/31, 32, 33, 22, 292/172, DIG. 53, DIG. 54, DIG. 68, DIG. 29, 160, 142

[56] References Cited

U.S. PATENT DOCUMENTS

| | | | |
|---|---|---|---|
| 2,166,535 | 7/1939 | Sarenholm et al. | 292/39 X |
| 3,110,512 | 11/1963 | Scale et al. | 292/39 X |
| 4,368,905 | 1/1983 | Hirschbein | 292/22 X |
| 4,616,864 | 10/1986 | Douglas | 292/39 X |
| 4,648,636 | 3/1987 | Reynard | 292/39 |
| 4,754,624 | 7/1988 | Fleming | 292/39 X |
| 4,848,811 | 7/1989 | Lauftsnberg et al. | 292/160 |
| 4,930,325 | 6/1990 | Ramsauer | 292/39 |

FOREIGN PATENT DOCUMENTS

| | | | |
|---|---|---|---|
| 21820 | 1/1981 | European Pat. Off. | 292/39 |
| 54225 | 1/1982 | European Pat. Off. . | |
| 176890 | 9/1985 | European Pat. Off. . | |
| 283659 | 9/1988 | European Pat. Off. | 292/39 |
| 1950153 | 10/1969 | Fed. Rep. of Germany | 292/39 |
| 2033042 | 1/1972 | Fed. Rep. of Germany . | |
| 7403366 | 6/1974 | Fed. Rep. of Germany . | |
| 3300423 | 7/1984 | Fed. Rep. of Germany | 292/39 |
| 3300976 | 7/1984 | Fed. Rep. of Germany | 292/39 |
| 8505588 | 1/1985 | Fed. Rep. of Germany . | |
| 3407700 | 9/1985 | Fed. Rep. of Germany . | |
| 3742995 | 8/1988 | Fed. Rep. of Germany | 292/39 |

*Primary Examiner*—Eric K. Nicholson
*Attorney, Agent, or Firm*—Darby & Darby

[57] ABSTRACT

Described is a bar closure for installation in one or two rectangular apertures (32, 34) in the fillet gap of sheet metal cabinet doors, which consists of a lock (16) with a lock nut (64) carrying a pinion (62) and held rotatably in a lock nut and bar bearing (60), which can be rotated by an actuating device led through the door panel (12) to the outside such as handle, pivot lever, socket wrench or the like; further, at least one bar (18) extending parallel to the door edge, in the fillet gap (10), which has a denticulation or perforation (66) to engage the pinion (62) in the region of the lock (16) and is displacably supported in this region and at least on one site outside the lock (16) on the door panel (12), as well as locking devices attached on the door frames respectively on the bar, which upon displacement of the bar engage each other. The bar (or the bars) as well as the lock nut and bar bearing (60) guiding these bars in the region of the lock (16), according to the invention, are built symmetrically or double-symmetrically, so that the bar closure can be used for right as well as for left-closing doors and the opening direction of rotation of the lock actuating device being freely selectable by turning or exchanging the bar(s) (18) and/or by turning the lock (16).

12 Claims, 22 Drawing Sheets

Fig.16A
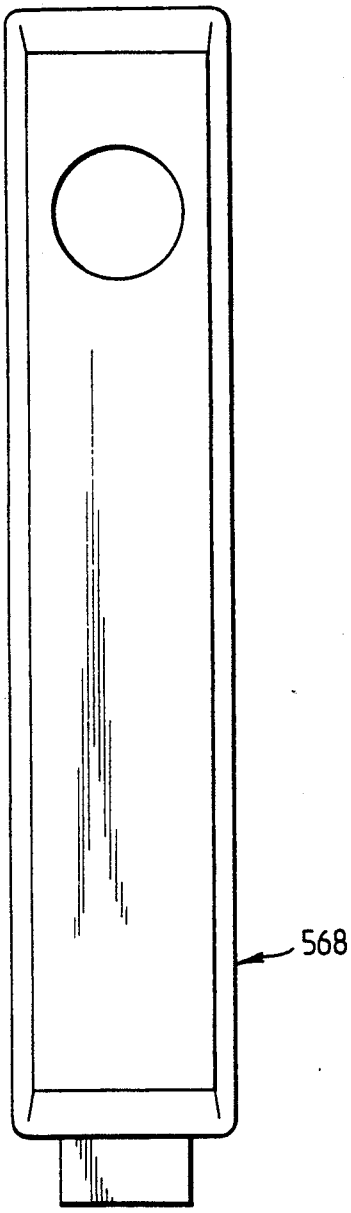
Fig.16B
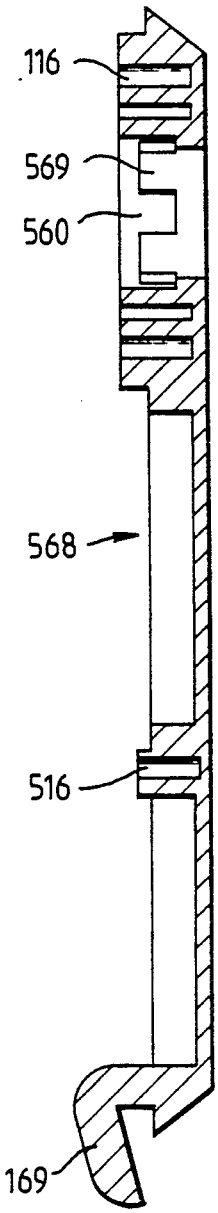
Fig.16C
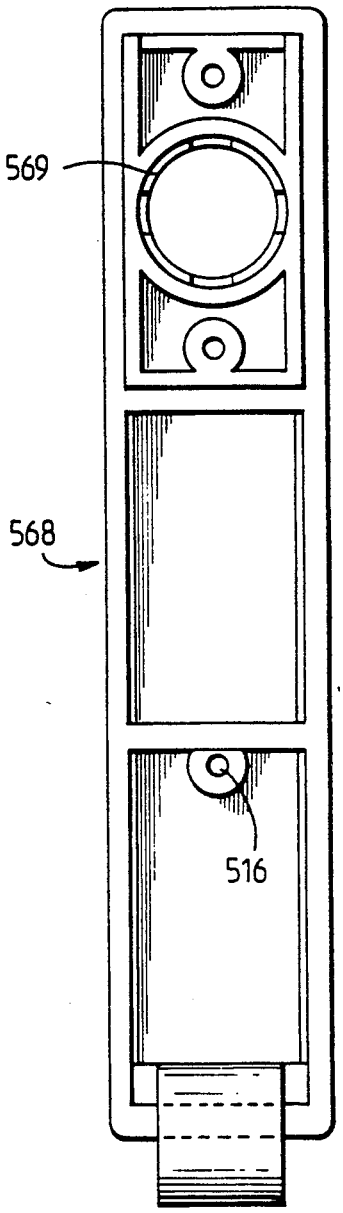
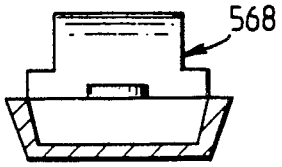
Fig. 16D.

BAR ENCLOSURE FOR SHEET METAL CABINET DOORS

BACKGROUND OF THE INVENTION

1. Field of the Invention

The invention relates to a bar closure for installation in one or two rectangular apertures in the fillet gap region of sheet metal doors.

1. Discussion of Prior Art

A rod closure can be found in DEP 34 07 700.

This rod closure has an advantage over other prior art constructions, such as in the German utility model 85 05 588 or the European patent 0 054 225, in that strip-shaped slide bars are used, so that the overall width of the bar closure remains significantly smaller than in the previous constructions and can also be placed in the relatively narrow fillet gap of sheet metal doors. This method of placing offers advantages that the inner clear volume of a switch cabinet (control cabinet) is fully available for other structural parts, such as switching devices, the space which would otherwise be dead is utilized, and the bar closure is outside of the region of the cabinet to be sealed off so that sealing devices are superfluous.

With special construction of the ends of the slide bars (arrangement of denticulations on both narrow sides of the ends of the slide bars), these slide bars are usable for left and right-attached switch cabinet doors. However, the bars (in the case of a preassembled lock) cannot, in simple manner, be exchanged. Rather, the pinion must be dismounted tediously from the lock, the bars must be taken out, exchanged in the intended manner, again replaced, and the pinion must be mounted anew. This is particularly true if a continuous slide bar is used. Such a bar cannot be slid into the guide channel of a preassembled lock box. But even in the case of non-continuous bars, in which the slide bar is provided with the denticulation at the end and, therefore, can per se be slid into the lock box from above or below, this sliding is due to still other guide devices and may only be possible after disassembling other structural parts. If the locking device arranged on the bar is formed by cuts in the bar, as is apparently provided in the prior art's bar closure (see European patent application 85 111 937.0 with the publication number 0 176 890), it is, in addition, difficult to use the bar on the left as well as on the right or to change the actuation device, because the bilateral cuts, which would in that case be necessary, could bring about considerable weakening of the bar.

SUMMARY OF THE INVENTION

It is an object of the invention to form a bar closure in such a way that it cannot only be used right and left, but that also the locking and opening direction of the lock can be freely determined so that subsequent changes can be made without involved disassembly work and without much weakening of the bar(s).

Furthermore, actuation with respect to the flat bar should be as axial as possible in order to preclude undesirable tilting, which increases friction. Such tilting phenomena is not always preventable in the prior bar closures.

Moreover, the armature consists of a minimum number of parts, is smooth-running, and permits ease of closing even if the locking devices must have a large contact slope because of provided sealing devices.

This is obtained by constructing the bar or bars, as well as a lock nut and bar bearing guiding the bar(s) in the region of the lock, symmetrically or double-symmetrically without disassembling the pinion. In this manner, the bar closure can be used for right and left-closing doors with the opening direction of rotation of the lock actuating device being freely selectable by turning or exchanging the bar(s) and/or turning the lock.

The bar closure of the invention can be used extraordinarily flexibly, can be easily assembled because the bars are identical, and is also particularly inexpensive to produce. In contrast, the bars based on prior art are not always entirely identical (the bar extending upward is, for example, shorter than that extending downward). In addition, the state of the art does not readily permit exchanging the bars.

In the prior art, only the arrangement of a lever closure is described. According to the invention, all possible kinds of closures customary in sheet metal cabinet construction can be used, possibly without changing the bar and also without changing the parts of the lock driving the bars. The construction according to the invention permits also axisymmetrical application of force on the bars, avoiding tilting processes of any kind, so that the bars can run extremely smoothly. When using double roll pins on the bars, this smoothness is even more pronounced. The arrangement consists of very few discrete parts, which reduces manufacturing costs and simplifies assembly. The cost-reduction of the manufacture and the simplification of assembly also extends to the door panel, because the lock according to the invention does not require apertures for securement in addition to the already available rectangular openings as in the case in the prior art. Measures to cover such additional apertures, in the event they are not used, become superfluous.

According to a further development of the invention, which, in particular, serves to transmit free of tilt the driving forces from the pinion to the bars, the bar of the bar closure provided with a flat-section is axisymmetrical with respect to the longitudinal axis and with respect to a transverse axis, which bisects the perforated respectively denticulated region of the bar.

In order to avoid having to provide the lock, in a complicated manner with a stopping arrangement, the bar, which is bent at right angles, is provided between the bend and the perforated (denticulated) region with a punched-out stop lug.

If the closure direction of the bars above and below the lock is intended to be in opposite directions, which offers advantages insofar as the door fittings are not acted upon by the load of the closure pressure, two separate bars are to be used with the one end of the bar lying behind the stop being cut off.

It is of particular advantage if the lock nut and bar bearing of the bar closure lock has a base part formed by the key catch and the key plate, which support the one end of the nut and a cap part. The cap part can be placed on the base part and then connected to it by screws or the like, which supports the other end of the nut and forms, together with the base part, four guideway slits for the bar(s).

It is favorable if the cap part has a central opening in the cap bottom for the nut bearing, one lug arranged above and one lug arranged below the central opening and one sunk bore projecting into the cap interior for receiving a fastening screw. In this way, the cap part can be readily removed for the purpose of exchanging, for example, the bars and for exchanging the kind of actuating device. If the lock nut and bar bearing consist of a base part and a cap part with essentially identical structures, further simplifications in production and, consequently, cost savings result. Assembly is further simplified, if the base part and cap part have counter guides. With projections projecting beyond the base part and the front face, a leaf spring can be arranged, which rests against the nut circumference and secures it against unwanted twisting, especially if the nut circumference has flat areas at a distance of 90° for receiving the leaf spring in the resting positions of the closure.

Through the particular construction of the lock according to the invention the base can be part of a pivot lever closure and also part of a hand lever closure, a double bit closure or some other kind of closure. Only one part of the entire closure needs to be exchanged, which results in considerable cost savings in terms of production as well as also in terms of maintaining stock and installation.

BRIEF DESCRIPTION OF THE DRAWINGS

Below, the invention is explained in greater detail with reference to embodiments, which are represented in the drawings, in which

FIGS. 16 A–D show respectively front plan, side elevational sectional, rear plan and bottom sectional views of another embodiment of a base part, into which different key catches can be set torsion-proof;

FIGS. 38 A,B respectively show side elevational and bottom views of a spring;

FIGS. 39 A,B respectively show side elevational and bottom views of a lock nut.

DESCRIPTION OF THE PREFERRED EMBODIMENT

Figure 1:
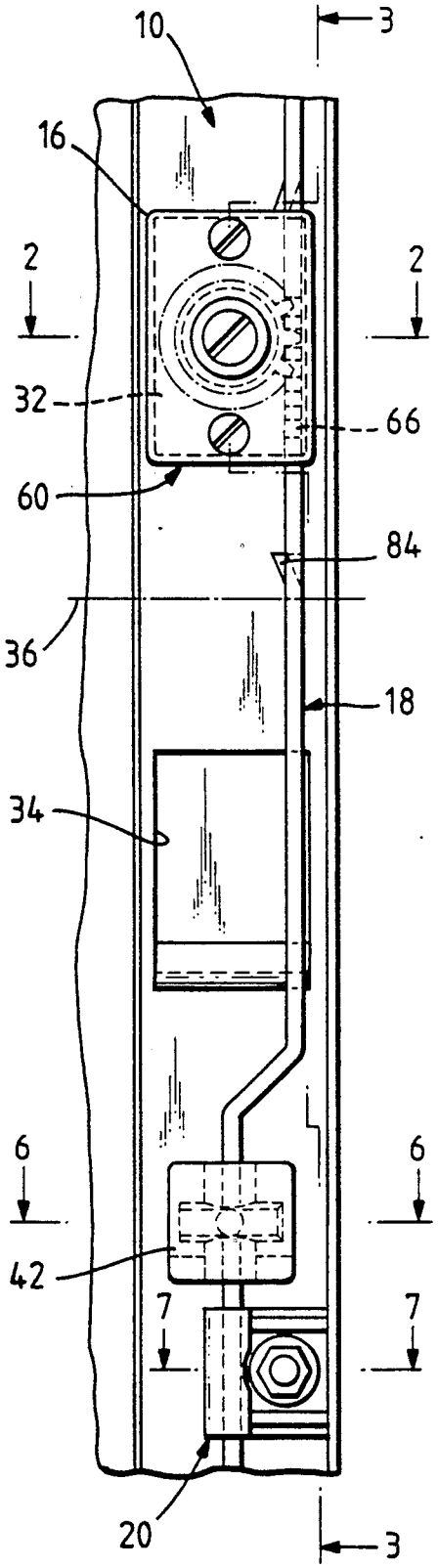
FIG. 1 shows an elevational view of the fillet gap of a sheet metal door with a bar closure according to a first embodiment of the invention installed in this fillet gap.
Figure 2:
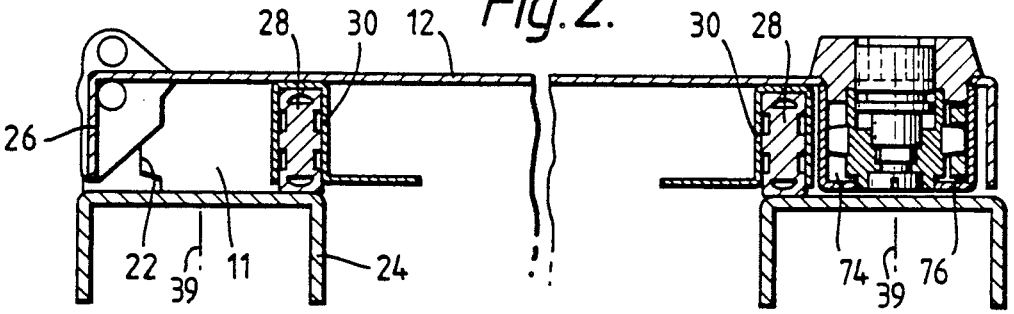
FIG. 2 shows an axial sectional view taken across section line 2—2 of FIG. 1 for illustrating the lock.

FIG. 1 shows the fillet gap 10 of a sheet metal door 12 with a bar closure 14 arranged in this space, consisting of a lock 16, from which a bar 18 extends continuing in the fillet gap 10. The bar 18 is slidably supported by the lock 16 and also on the door panel 12 in a bar bearing 20. The sheet metal door 12 is articulated to the cabinet body 24 with joint hinges 22 (see FIG. 2). The hinges, in turn, utilize the other fillet gap 11, which is formed between the outer bend 26 and a section sheet 30 welded onto the inside of the door panel holding a seal 28. Customarily in sheet metal cabinets, which have such fillet gaps 10, 11, a rectangular aperture 32 or 34 is arranged in the fillet gap for the closure; if use of sinkable pivot lever closures is planned, two rectangular apertures 32 and 34 are arranged symmetrically to the horizontal door center 36.

Figure 3:
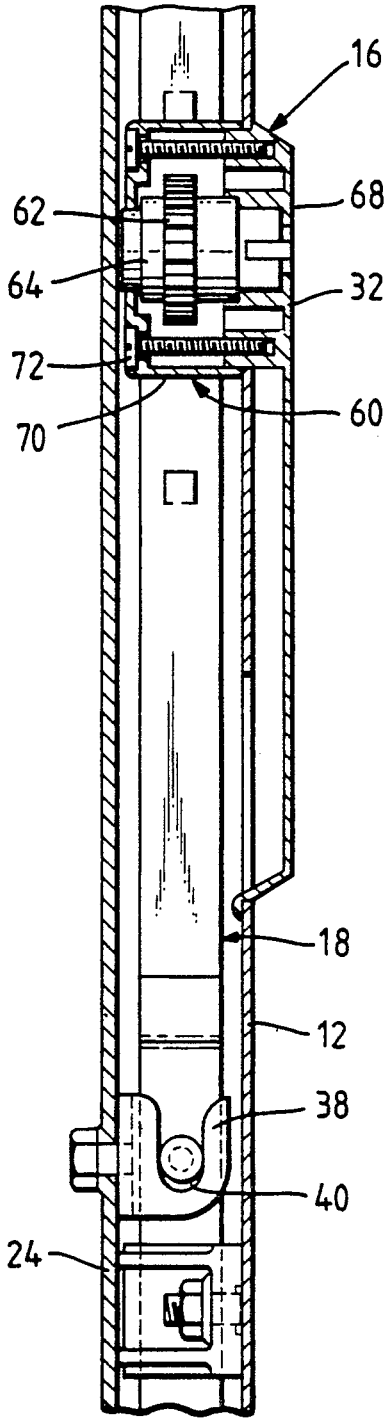
FIG. 3 shows an axial sectional view taken across section line 3—3 of FIG. 1 of an embodiment in which the closure is actuated by a socket wrench.

As can be seen in FIG. 3, which is an axial sectional view along line 3—3 of FIG. 1, a hook-like projection 38 is screwed on the cabinet body 24, into which, upon the bar closure being closed, a double roll pin 40 supported by the closure bar 18 penetrates and in this way forms a locking assembly 42. In the sectional view 6—6 through this locking assembly 42 it can be seen that the bar 18, which is rectangular in cross section and formed of flat strip material, carries a peg 44 in press fit (see also FIGS. 24 A-D). Bar 18 also carries rollers 46, which can be rotated bilaterally. The rollers have so much play that they can readily be rotated, but cannot slide from the peg 44. This is due to the presence of a head 48 on the one side of the peg 44 and a flange (bead) 52, which after assembly of peg and rollers is arranged on the opposite side of the peg.

Figure 6:
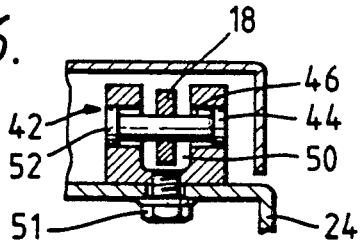
FIG. 6 shows a sectional view through the locking device with double roll pin arrangement taken across section line 6—6 of FIG. 1.

The hook 38 is provided with a slit 50 for receiving the bar 18, with the hook having a U-shape in section C—C, (FIG. 6) and the web of the U having a threaded bore into which a fastening screw 51 can be screwed in order to fix the hook. The hook may have also a safeguard against rotation, for example, in the form of a prismatic aperture in the cabinet body 24, into which the corresponding projections of the hook fit torsion-proof.

Figure 7:
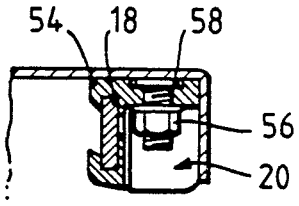
FIG. 7 shows a sectional view through the bar guide taken across section line 7—7 of FIG. 1.
Figure 8:
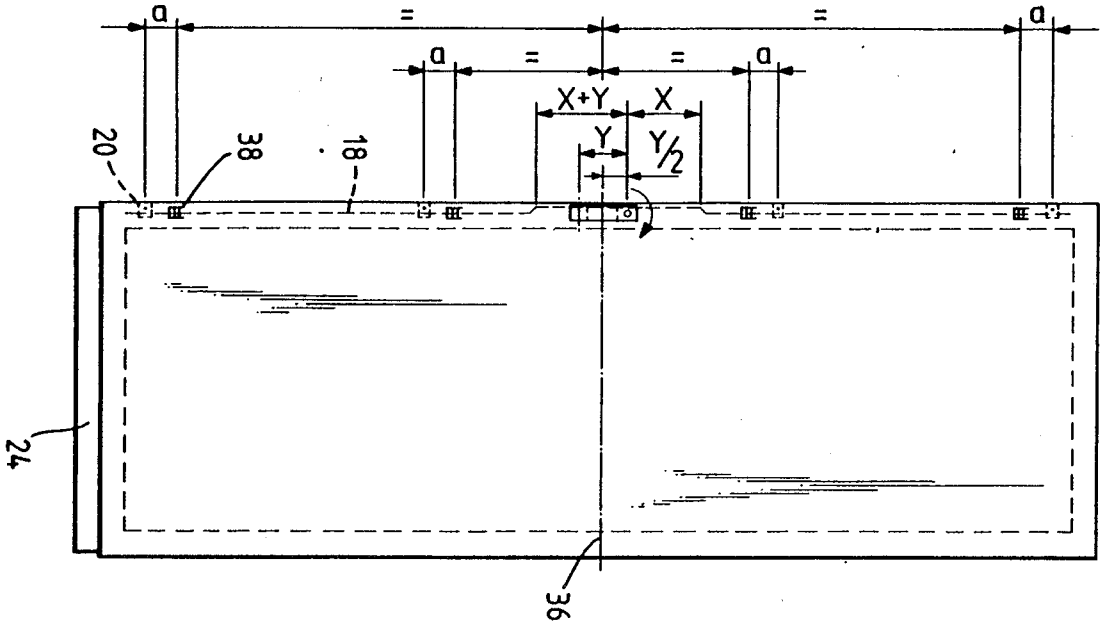
FIG. 8 shows an elevational view from the outside onto a door with an installed bar closure according to the invention, in which the actuation device is to be actuated in the clockwise direction.
Figure 9:
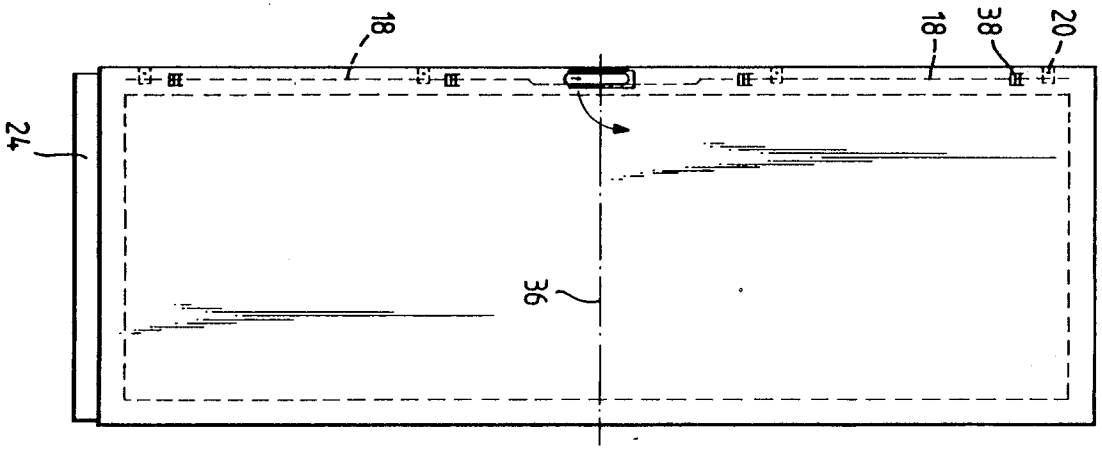
FIG. 9 shows a view corresponding to FIG. 8 but with an actuation device (pivot lever), which is to be actuated in the counterclockwise direction, in which the corresponding differently arranged closure bar is shown in dashed lines.

A possibility for guiding the bar is shown in section 7-7. Here the bar guide 20 (see FIG. 7) is arranged torsion-proof with a stud bolt arrangement in the corner space of the chamfered channel 10 and formed so that the flat strip bar 18 can be slid into the guideway after previously bending away a projection 54, whereupon the fastening nut 56 of the welding bolt 58 can be tightened. The nut causes the hook 54 to press against the bar 18 providing a safeguard. The guideway 20 can, indeed, also be arranged on the other side of the bar 18 outside of the corner region of the door panel which sometimes is difficult to access for welding work.

It is, furthermore, clear from FIG. 3 that the lock 32 comprises a lock nut, pinion and bar bearing 60, which holds a lock nut 64 supporting a pinion 62. The lock nut 64 can be rotated; in this case, with an actuation device extending to the outside such as handle, pivot lever (see FIG. 4), socket wrench (FIG. 3) or the like, with the pinion, which engages corresponding perforations or denticulations 66 of the bar 18, sliding the bar up and down.

As shown in FIG. 3, the lock nut, pinion and bar bearing 60 consists of a base part 68, in which the one end of the lock nut 64 is supported, and a cap part 70, which can be set onto the base part 68 and fixed with screws 72 on the base part and supports the other end of the nut. As is apparent in the sectional representation 2—2 of FIG. 2, the lock nut, pinion and bar bearing 60 form also guide slits 74 and 76 for selectively placing the bar 18 either in the manner shown, in which the locking direction is clockwise, or into channel 74, in which a reversed locking direction for the actuation device results.

Figure 10:
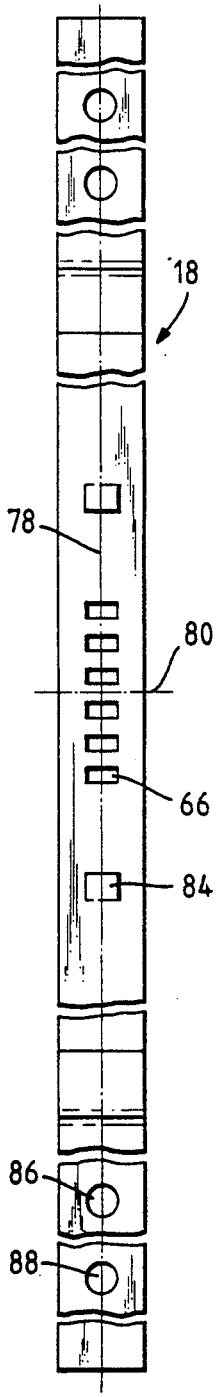
FIG. 10 shows a plan view of a double-symmetrical closure bar.
Figure 11:
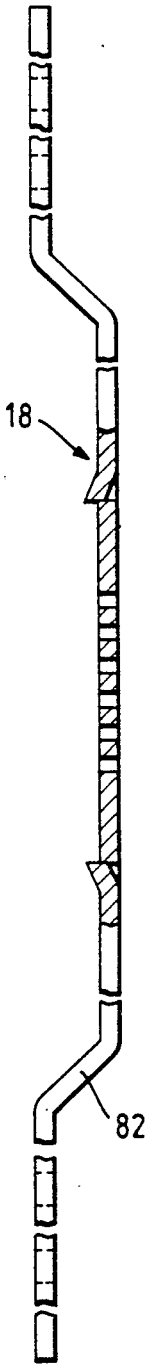
FIG. 11 shows a side view of the bar of FIG. 10.
Figure 12:
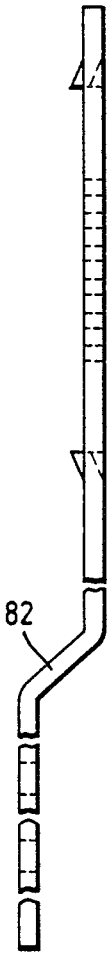
FIG. 12 shows a side view as in FIG. 11, but where one end of the bar is cut off.
Figure 36A:
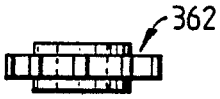
FIGS. 36 A-C show respectively an elevational view of a bar pinion arrangement with a pinion, which forms a stop for limiting push-out of the bar, an elevational view of the pinion alone and a top view of the pinion alone.
Figure 36B:
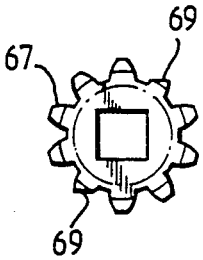
Figure 36C:
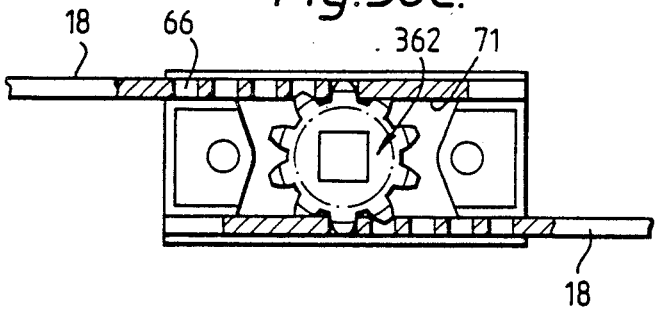

In order to permit turning of the continuous bar 18 and, in this manner, changing direction of rotation with respect to the actuation device without needing to undertake other changes, the bar 18 is may be (see also FIGS. 10 and 11) built two-fold axisymmetrically, once around the longitudinal axis 78 and the transverse axis 80. The symmetry in this case extends to punched out lugs 84, which rest on the outer surface of the lock 16 and, in this way, limit the motion path of the bar and the right-angle bends 82, which provide the free space for arranging the pinion 62. Also affected by the symmetry are the bores 86, 87, which are provided for receiving the already described double roll pins 40. The motion path of the bar can also be limited in that the bar perforations 66 of the bar 18 in each instance comprises only n teeth 67 (where n=5 according to FIGS. 36 A-C), of which two opposing teeth have a flattened stopping face 69. The flattened area of the stopping face may preferably be in contact with the bar plane 71 when the adjacent tooth engaging the last perforation hole stands perpendicular to the bar plane.

Figure 13A:
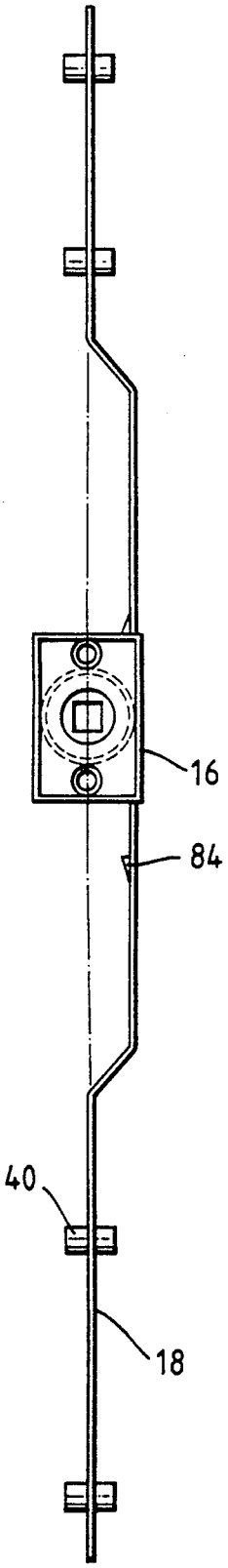
FIGS. 13 A–C show respectively right side, front, and left side elevational views of the bar according to FIGS. 10 and 11 with an installed double roll pin as locking organs and installed in the actuation lock once for left operation and once for right operation.
Figure 13B:
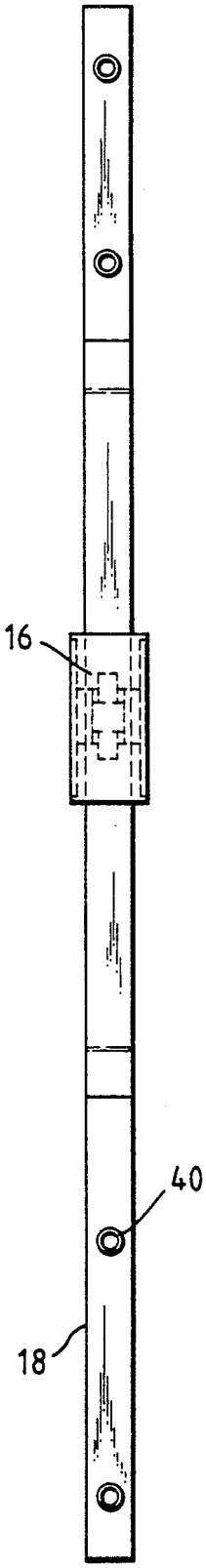
Figure 13C:
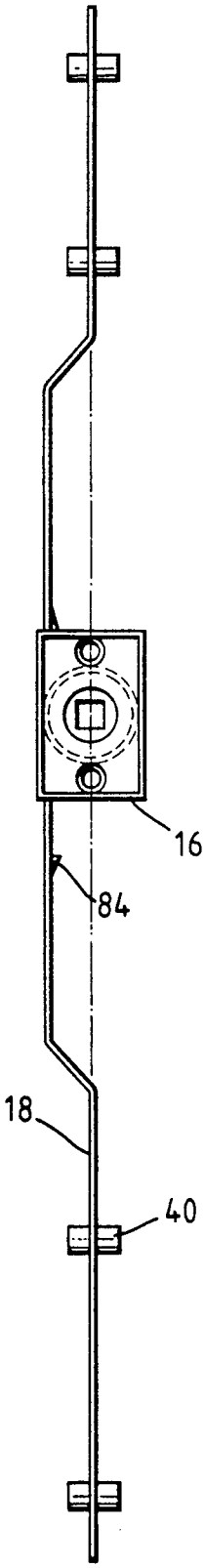
Figure 14A:
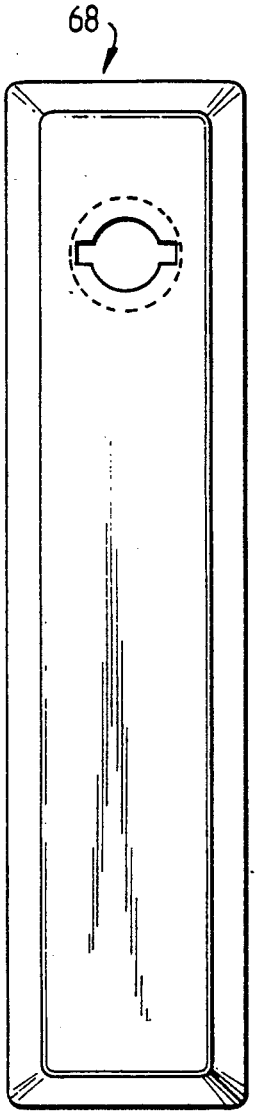
FIGS. 14 A–D show respectively front plan, side axial sectional, rear, and bottom sectional views of the base part of the closure shown in FIG. 3.
Figure 14B:
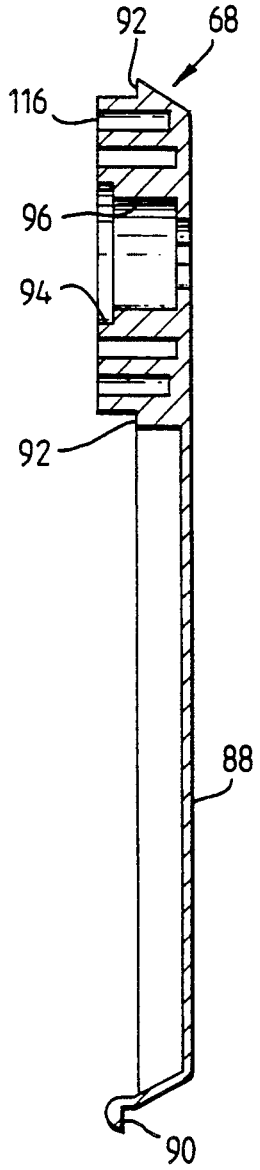
Figure 14C:
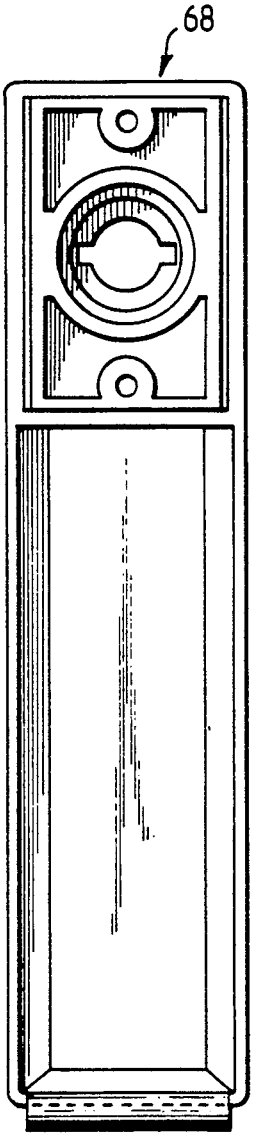
Figure 14D:
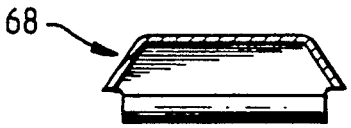
Figure 15A:
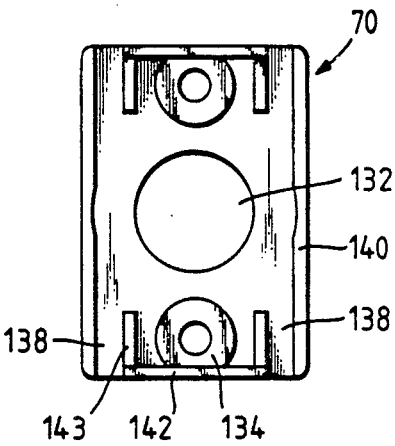
FIGS. 15 A–D show respectively front plan, side axial sectional, rear plan and bottom sectional views of the corresponding cap part.
Figure 15B:
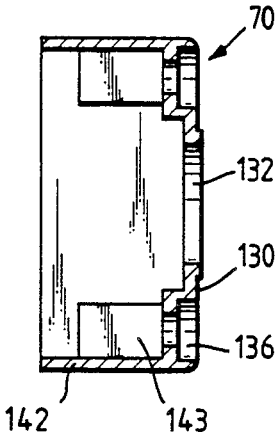
Figure 15C:
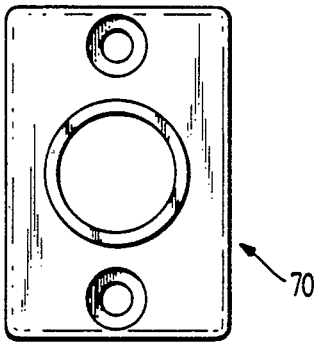
Figure 15D:
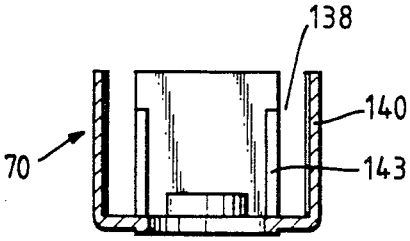

In FIGS. 13 A-C, the two described arrangements of bar 18 are shown, which also show the double roll pins 42.

FIGS. 14 A-D show a base part 68 which serves for a double bit closure and simultaneously covers the second rectangular hole 34. It lies as unitary cover plate 88, which changes over into a hook 90, behind the lower edge of the aperture 34. The upper end of the base part 68 extends through the rectangular opening 32 and is aligned with an edge 92. The bearing for the lock nut 64 has a circular depression 94 and a further depression 96 of smaller diameter to receive the head 100 of a double bit lock inset 98.

Figure 17A:
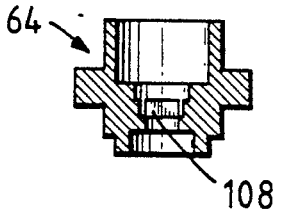
FIGS. 17 A,B show respectively bottom and side elevational sectional views of the pinion according to FIG. 3.
Figure 17B:
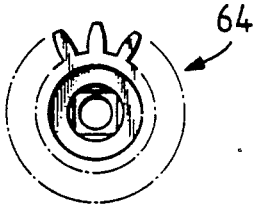

Another part of this head, which has a circumferential groove 104 for receiving an O-ring seal and a foot part 102 in the pinion 64 (see FIGS. 17 A, B), is supported torsion-proof. A screw (not shown here) which can be screwed into a threaded pocket hole 106 and a square plug connection 108 in the lock nut permits a torsion-proof connection between these two structural parts 64 and 98. The structural parts could also be integrated into one piece. The advantage of this combination of two parts is that the inset 98, which is here provided for a double bit key, can easily be exchanged, in simple manner, for another kind of key, so that the pinion 64 can be used for entirely different keys.

Figure 4:
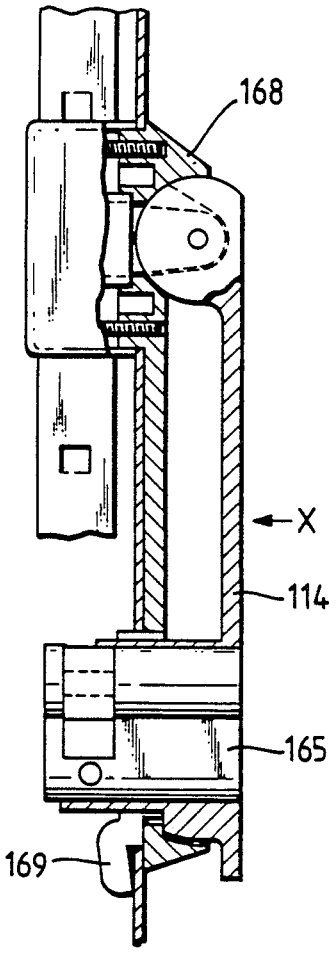
FIG. 4 shows an elevational view for an embodiment where a pivot lever serves to actuate the bar closure.
Figure 5:
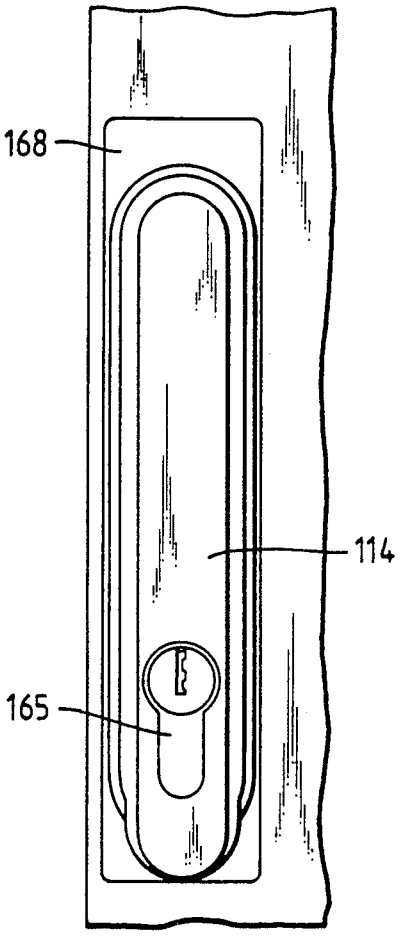
FIG. 5 shows an elevational view of this closure provided with pivot lever as viewed in the direction X of FIG. 4.
Figure 20A:
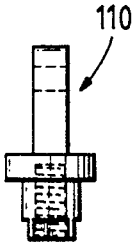
FIGS. 20 A–C show respectively front plan, side elevational and bottom views of the pinion inset used in the pivot lever closure according to FIG. 4 for linking the pivot lever.
Figure 20B:
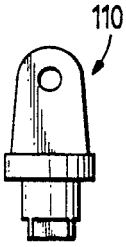
Figure 20C:
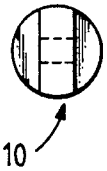
Figure 24A:
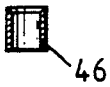
FIGS. 24 A–D respectively show bottom and side elevational views for one structural part and bottom and side elevational views for another structural part required for the arrangement of the double roll pins on the actuation bars.
Figure 24B:
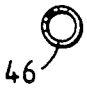
Figure 24C:
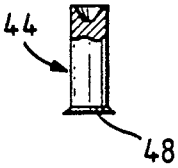
Figure 24D:
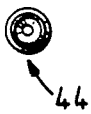
Figure 18A:
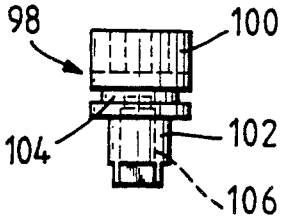
FIGS. 18 A,B show respectively bottom and side elevational sectional views of the socket wrench inset which can be placed into the pinion, here for a double bit key.
Figure 18B:
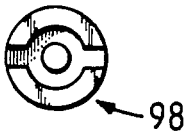
Figure 19A:
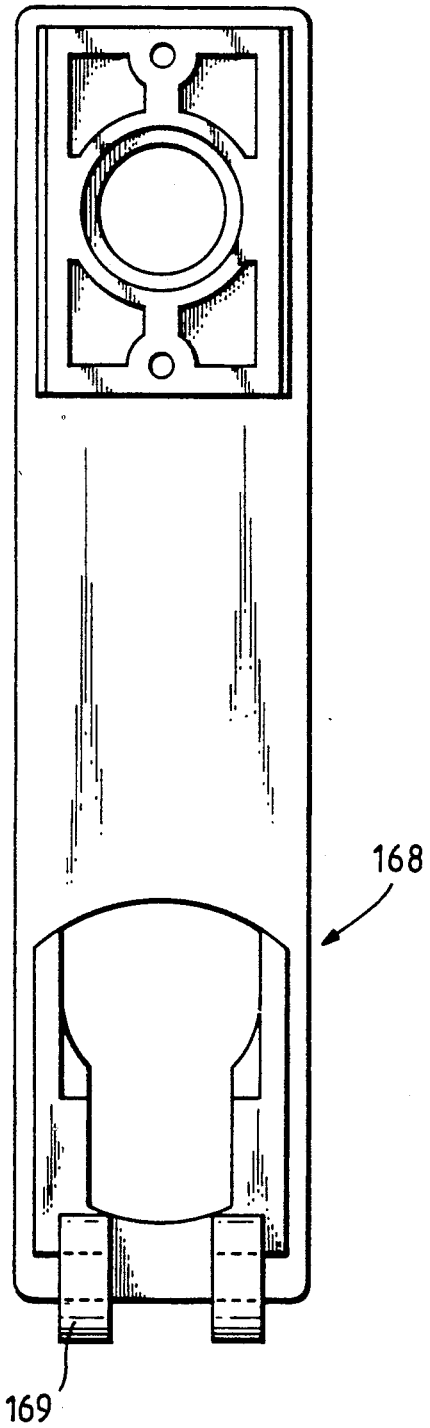
FIGS. 19 A–D show similar views as in FIGS. 14 A–D but for a base part for a lever closure to which the cap part according to FIG. 15 and the pinion according to FIG. 17 fit.
Figure 19B:
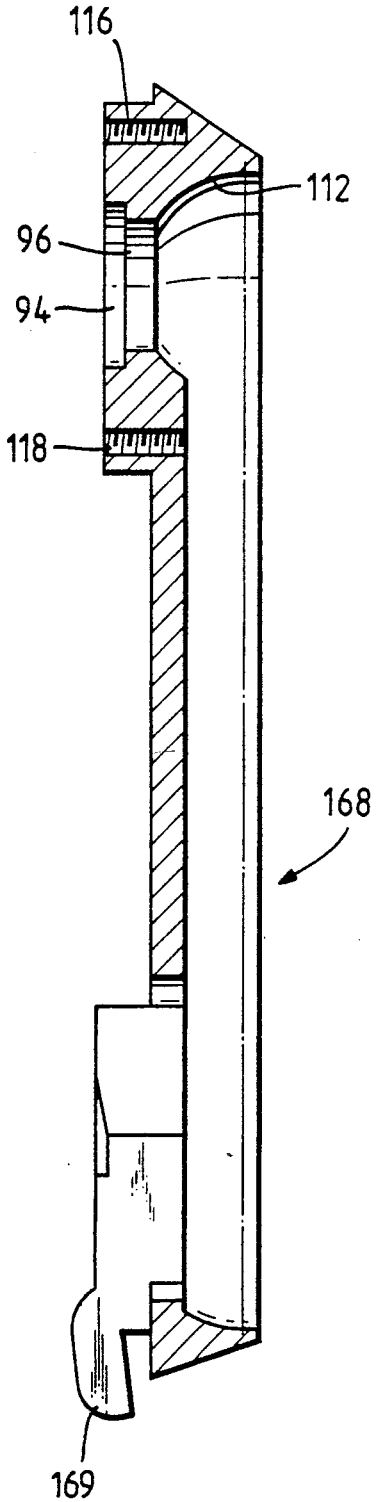
Figure 19C:
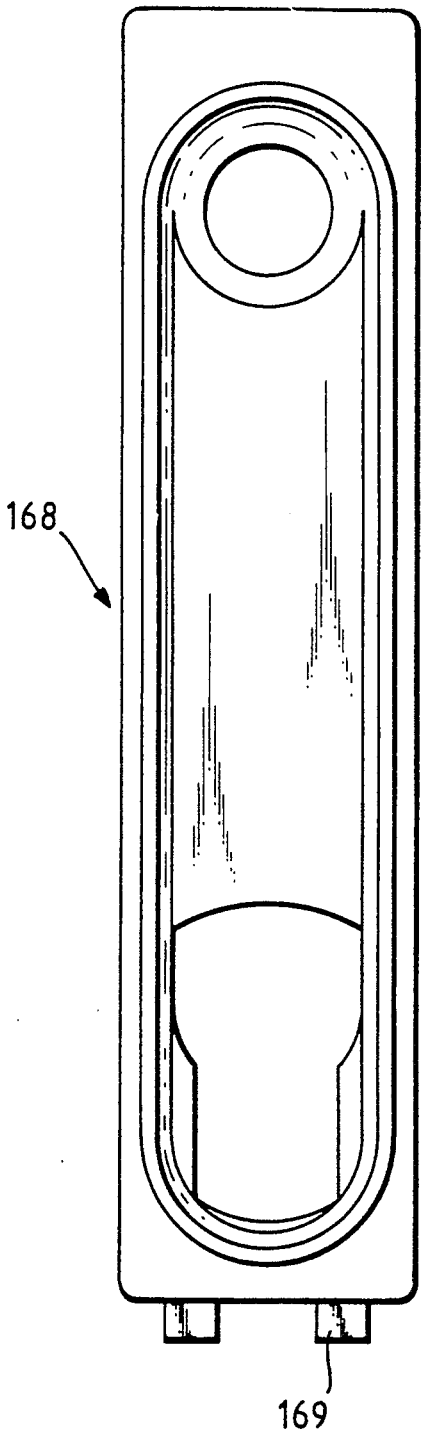
Figure 19D:
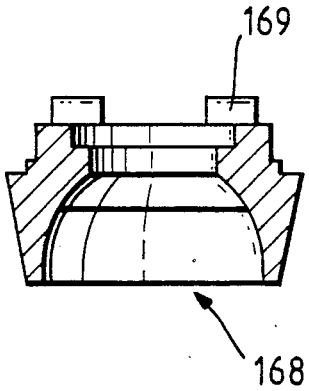

Thus, for example, instead of inset 98 according to FIGS. 18 A, B, the pivot bearing of a pivot lever closure as it is shown in FIG. 4 can be used (see FIGS. 20 A–C). This pivot bearing 110 with the associated pinion 64 (FIG. 17) can then be set into a base part 168, which is shown in greater detail in FIGS. 19 A–D. This base part 168, in turn, has a depression 94 and a bearing surface 96, but has, in addition, a spherical surface 112, in order to be able to support a pivot lever 114, which can be recognized as a discrete part in different representations (see FIGS. 25 A–D).

Figure 26A:
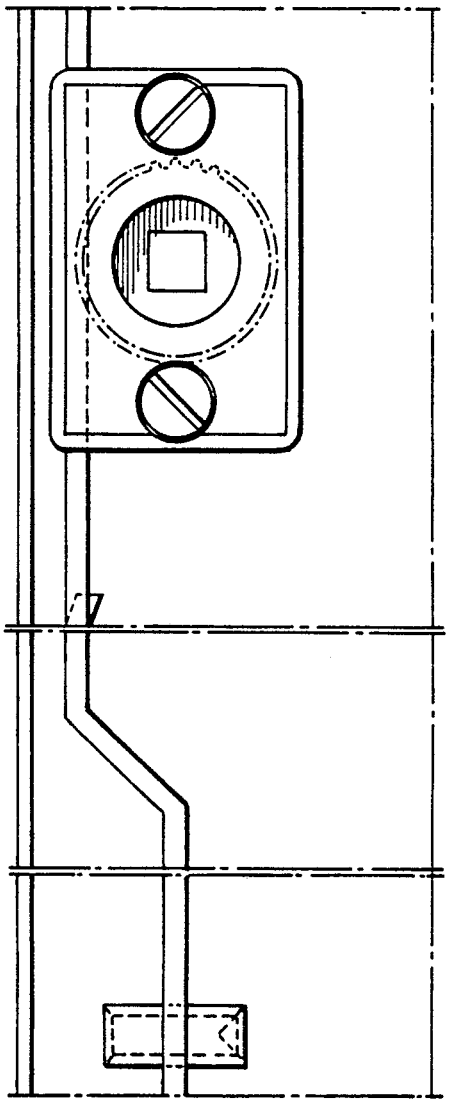
FIGS. 26 A–C show side elevational, rear sectional, and top sectional views of a further embodiment of the bar closure according to the invention with a further symmetrized lock nut and bar bearing device.
Figure 26B:
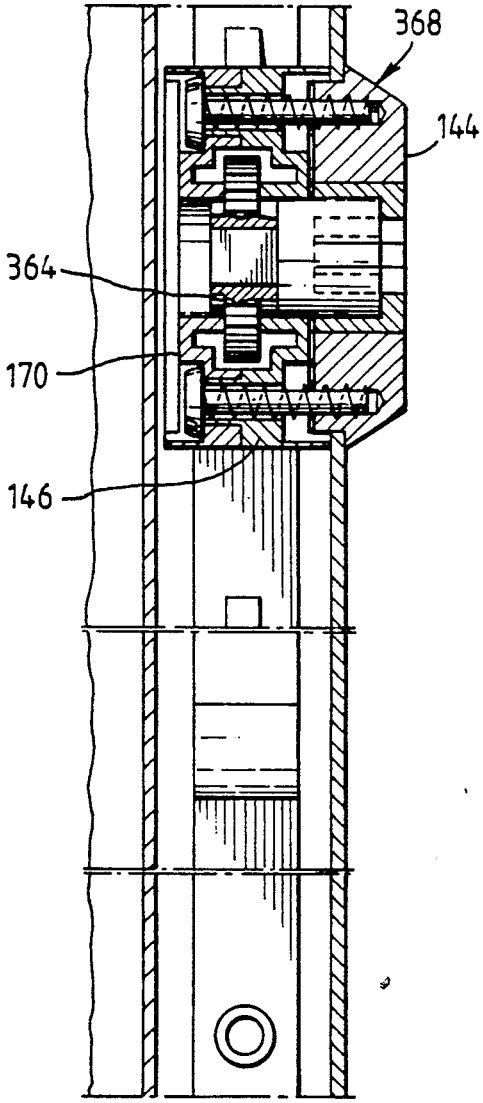

The base part can be so constructed that it is suitable for the use with different key catches (see the embodiments shown in FIGS. 19 A–D, FIGS. 34 and 35, respectively with the reference number 168 and 468, respectively, as well as the structural part 368 and 668 in FIG. 26B and FIG. 37B, respectively, which structural parts will be discussed later).

The base part 68, in its different embodiments is customarily injection molded or made of synthetic materials and, in this case, will have injected pocket bores 116 or penetration bores 118 into which the fastening screws 72 cut, creating their own threads. If the parts are made of injected metal, the corresponding threaded pocket or penetration holes will be provided.

The bar bearing 20 should also be made of a synthetic material, while the hook 38 (due to the greater load) will most frequently be made of metal. The slide bearing is essentially wear-free and requires low frictional forces if made of the synthetic material such as plastic. In addition, due to the double roll pin locking, the slide bearing remains free of tilting forces and, therefore, ensures a smooth-running, turnable locking mechanism. Through the appropriate design of hook 38 with, for example, a large incline, even doors with large-area seals 28 can be closed safely.

If only a single bar 18 is used, the hooks 38 will all be turned in one direction; if two bars are used for actuation in opposite directions bringing about reduction of the load on the door fittings, the hooks for the one bar have a different orientation than the hooks for the other bar. The advantage of this double bar arrangement is that the frictional forces originating during actuation of the door cancel each other at the door panel and no forces are transmitted by the door panel onto the door frame. These frictional forces, however, when using double roll pins, as is provided here, are relatively small, so that the use of only one actuation bar is possible without creating difficulties.

Figure 22A:
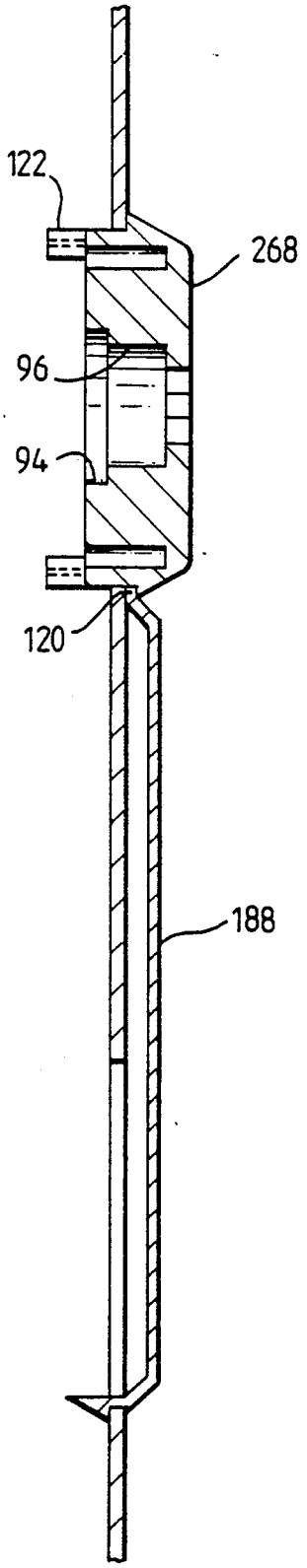
FIGS. 22 A,B show respectively front plan and side sectional views of another embodiment of a base part with separately insertable cover plates for the second rectangular aperture according to FIG. 16 and device for zero-point stopping with separate representations of the individual parts of the stopping device (spring and chamfered pinion part)
Figure 22B:
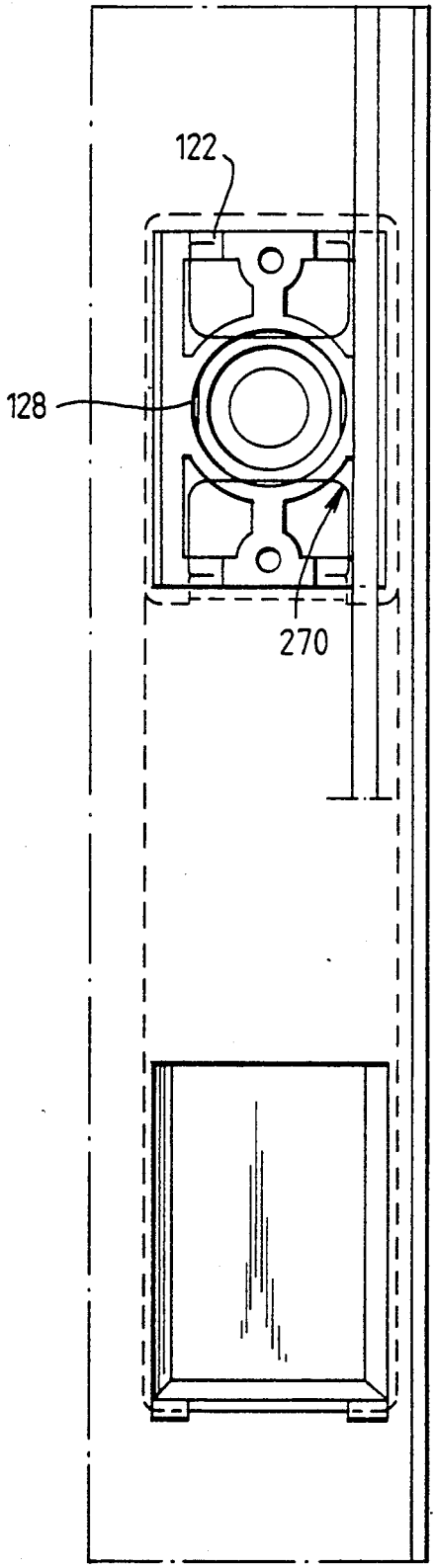
Figure 22C:
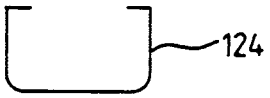
Figure 22D:
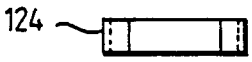
Figure 22E:
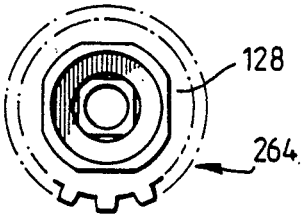
Figure 22F:
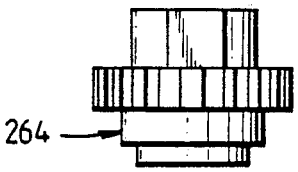

There are cabinets which have only one rectangular aperture 32. In this case, a second aperture 34 does not need to be covered. In this case, a simplified base part, which does not have the cover plate 88, suffices. It can, however, also be so designed (see FIGS. 22 A–B) that a cover plate 188 can later be plugged into a corresponding depression 120. The base part 268 shown in FIG. 22A, which with respect to the nut bearing which corresponds to the base part 68 of FIGS. 14 A–D, has overall four projections 122, which hold two spring buckles 124. The spring buckle trails on the circumference of the nut 264, which is provided with flattened areas 128, in which the spring 124 (as shown on the right in FIG. 22) lies. In this way, the spring buckle brings about stopping in four positions displaced by 90°.

Onto the base part 68, 268, 368 or 568 shown in FIGS. 3, 22 A–D, 26 A–C, 16 A–D in different embodiments and after insertion into the aperture(s) 32, 34 in the door panel 12 and insetting of the selected kind of lock nut 64, 264 as well as after appropriate application of associated actuation bars 18, the cap part 70 or 170 can be placed (see FIGS. 15 A–D). The cap part 70 has a central opening 132 in the cap bottom 130 for bearing the nut and one eye 134 each arranged above and below the central opening 132 and projecting into the cap interior with a sunk bore 136 for receiving the fastening screw 72.

From the cap bottom 130, two longer side walls 140 extend parallel to the guide slits 138, as well as the shorter side walls 142 which extend perpendicular to them. The shorter sidewalls 142 adjoin the eye 134 and from their end edges lead a support and guide wall 143 projecting into the cap interior. In each instance, the end edges are arranged parallel and at a distance from the longer side wall 140 forming part of the guide slit 138. This cap part 70, for example, fits onto the base part 68, 168, 268 according to FIGS. 3, 4, 19 A–D, 22 A, B, with the wall 143 extending to the inner front face, for example, of the base part 68. The pressure exerted by the fastening screws 72 is, however, transmitted essentially by the front faces of the side walls 142, 140 onto the edge region of the door panel aperture 32 (according to FIG. 1) and serves for the purpose of holding the closure securely in the door panel.

Figure 34:
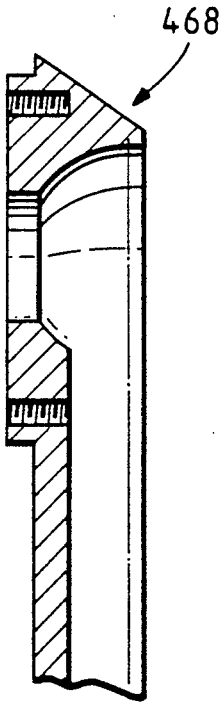
FIG. 34 shows a partial sectional view similar to FIG. 19 B of the base part, which is for a pivot lever closure.
Figure 33:
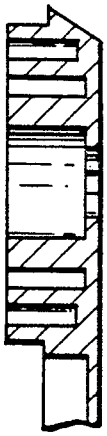
FIG. 33, shows a partial sectional view similar to FIG. 14B of the base part but which is for the structural parts according to FIGS. 27 A-D and 28 A-D.
Figure 31A:
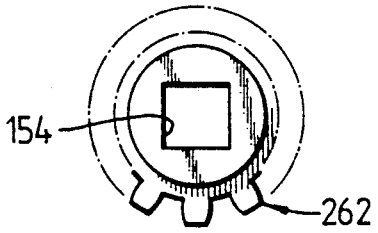
FIGS. 31 A–D show top and side elevational views respectively of an associated pinion with square inset.
Figure 31B:
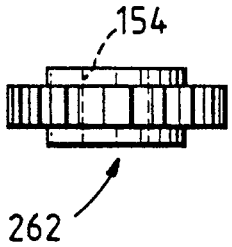
Figure 31C:
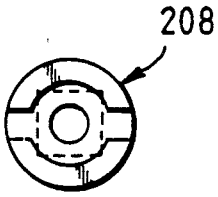
Figure 31D:
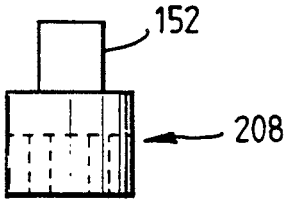

In FIGS. 14 A–D and 19 A–D a somewhat modified embodiment of the particular base part can be seen, denoted by FIGS. 33 and 34, which are modified insofar as the part extending into the door panel is shortened so that the depression 94, which previously functioned as the bearing of the nut, becomes superfluous. These base parts (shown in FIGS. 26 A–C in greater detail) consists of two parts, namely, a key catch part 144 and a bearing part 146. The bearing part has essentially the same structure as the associated cap part 170 (see FIGS. 27 A–D) and bearing part 146 (see FIGS. 28 A–D). The two parts differ solely in that the bearing part 146 has projecting lugs of annular projections 148 which fittingly engage the set-offs arranged in the cap part 170 and are accommodated in correspondingly enlarged sunk bores 336. Fitting the two parts together brings about reciprocal locking of the two parts. It is, however, also conceivable to lead tubular rivets through the sunk bores 236, 336 and effect reciprocal locking of the parts with them, whereupon the two parts can be made completely identical. Using tubular rivets would permit pre-assembly of the lock nut, pinion and bar bearing at the manufacturing plant.

An additional advantage is that this pre-assembled lock nut, pinion and bar bearing can be combined with different key catches forming the rest of the base part such as are already described in FIGS. 33 and 34. Since the parts forming the lock nut, pinion and bar bearing are identical, the cost of production and the cost of maintaining stock are further reduced and a modular system originates, which permits application possibilities with very few parts. Thus, the lock nut and bar bearing shown in FIGS. 26 A–C, consisting of the parts 368 and 170, can be linked instead of with the key catch part 144. Linking is effected with the associated square inset shown in FIG. 31 double bit inset 208 (which can be plugged into the entirely symmetrical pinion 262 likewise shown in FIGS. 31 A–D) with a pivot lever base plate 468 such as is shown as an alternative in FIG. 34. This pivot lever base plate 468 with installed pivot lever 114 can be seen in FIG. 35. A pivot lever bearing pin 210 differs from the pivot lever bearing pin 110 shown in FIGS. 20 A–C by an enlarged bearing part 150 adapted to the bore diameter of the base part 146 and the square 152 extending from it for plugging into the corresponding square opening 154 of the pinion 262 shown in FIGS. 31 A–D. The pivot bearing 210 is secured with a bolt extending from the square 152, onto which a screw can be attached, as can be seen in FIG. 35. As FIGS. 26 A–C show the key catch part 144 which can, in turn, be multiple parts in order to achieve increased flexibility. FIG. 26A shows a key catch 144 with an insert 154, which is shown separately in FIGS. 32 A, B and adapts the key catch 144 to so-called double bit keys (see reference number 156 in FIGS. 32 A, B). To the right of the double bit inset 154 shown in FIG. 32 is shown an inset 254 appropriately modified for square keys.

Figure 23A:
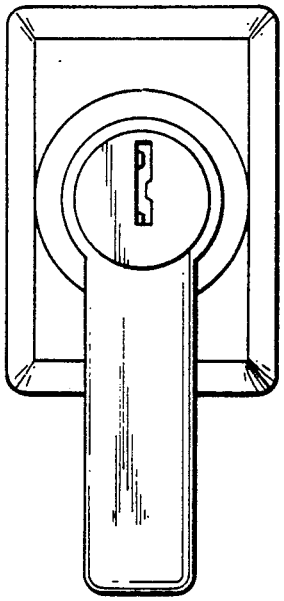
FIGS. 23 A,B show respectively front plan and side elevational views of a lockable simple lever closure with arrangement for receiving a cover plate according to FIG. 16.
Figure 23B:
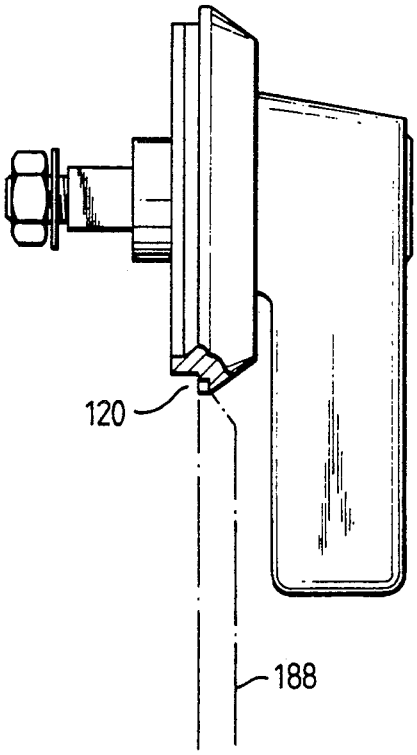
Figure 29A:
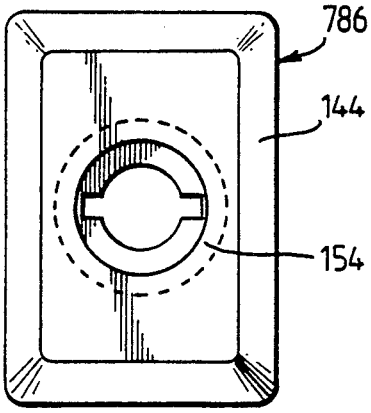
FIGS. 29 A,B show views corresponding to FIGS. 23 A, B but for an outer base part for the closure of FIGS. 26 A–C.
Figure 29B:
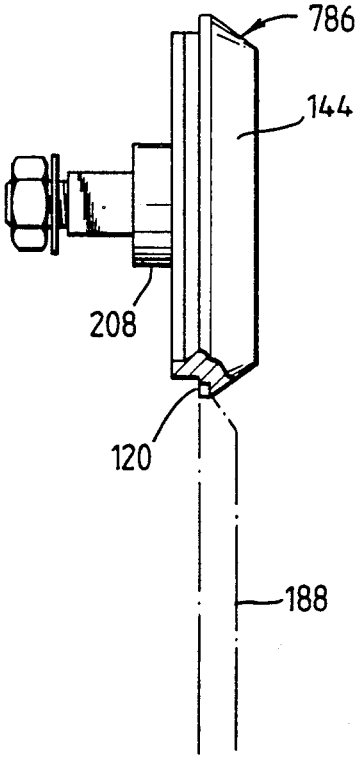
Figure 25C:
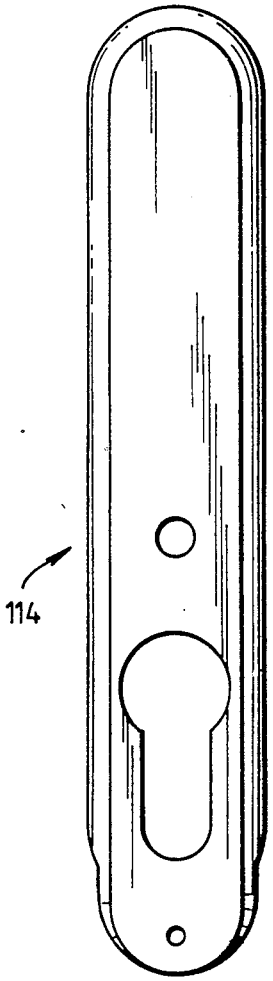
FIGS. 25 A–D show similar views as those of FIGS. 14 A–D but for the pivot lever base according to FIGS. 19 A–D and 34.
Figure 25B:
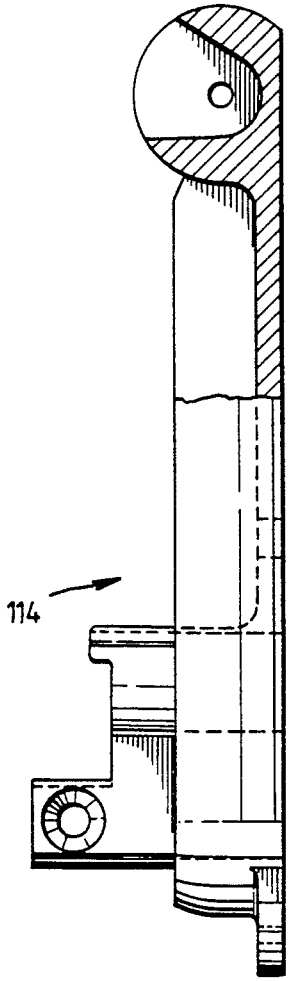
Figure 25A:
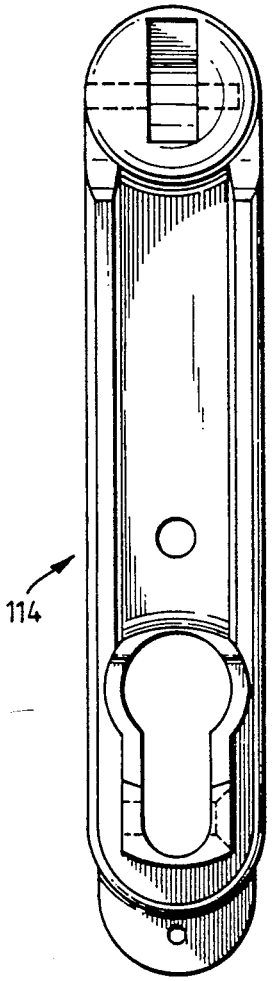
Figure 25D:
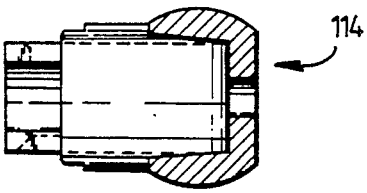
Figure 26C:
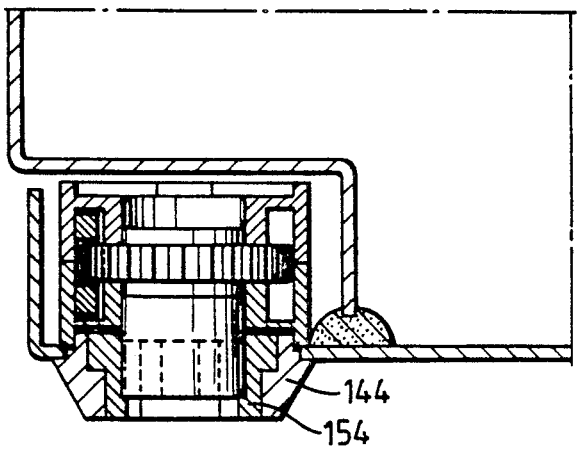
Figure 27A:
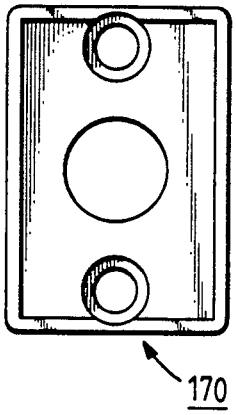
FIGS. 27 A–D show similar views to those of FIGS. 14 A–D, but for the cap part of the closure according to FIGS. 26 A–C in four views.
Figure 27B:
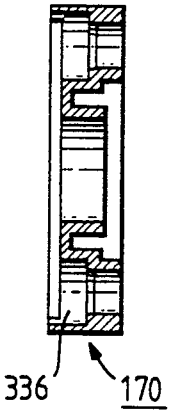
Figure 27C:
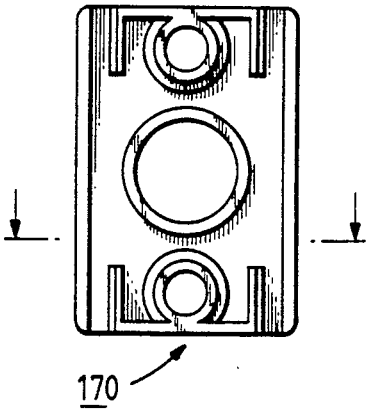
Figure 27D:
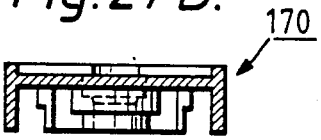
Figure 28A:
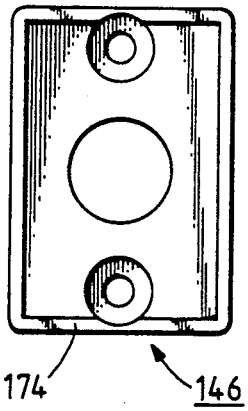
FIGS. 28 A–D show similar views to those of FIGS. 27 A–D but for the inner base part of the closure according to FIGS. 26 A–C.
Figure 28B:
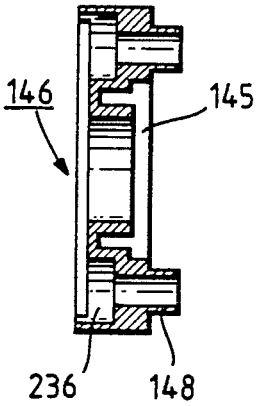
Figure 28C:
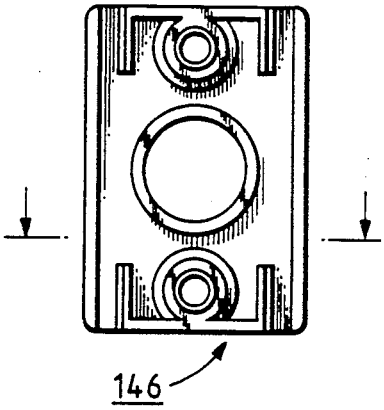
Figure 28D:
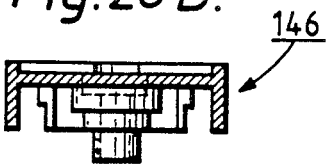
Figure 30A:
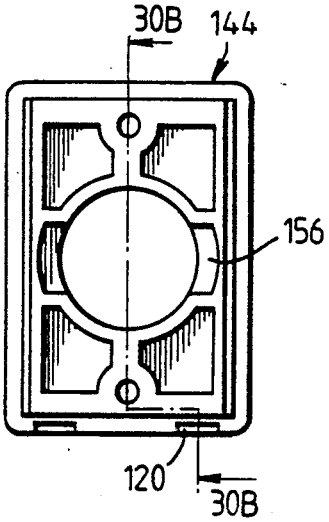
FIGS. 30 A–D show similar views to those of FIGS. 15 A–D but for a cover plate fitting a base part according to FIGS. 29 A,B.
Figure 30B:
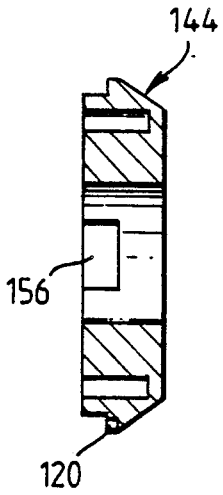
Figure 30C:
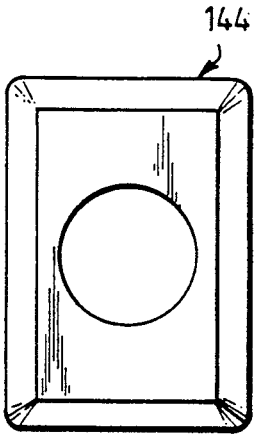
Figure 30D:
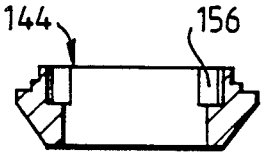

FIGS. 29 A, B show the key intake 144 according to FIGS. 26 A–C with inset 154 and square socket connection 208 again separately from the front and from the side, with a key catch 144 having a set-off 120 for receiving a cover plate 188. Similarly constructed could be a simple pivot closure, which can be locked up (see FIGS. 23 A, B). The key catch provided for the inset 154 or 254 shown in FIGS. 32 A, B with a corresponding depression for inset projections 158 is evident in FIGS. 30 A–D. This figure also permits recognition of the more precise shape of the set-off 120 for receiving corresponding lugs 160 of the supplemental covering 188.

FIGS. 16 A–D show a base part 568 similar to that of FIGS. 19 A–D, in which exchangeable key catches are provided. The base part is here particularly narrow and the key catch safeguard against rotation is formed by axial locking fingers 569 directed in the direction of the lock nut, which form between themselves annular section-shaped interspaces 560, into which the corresponding projection of a key catch inset can engage.

Figure 21:
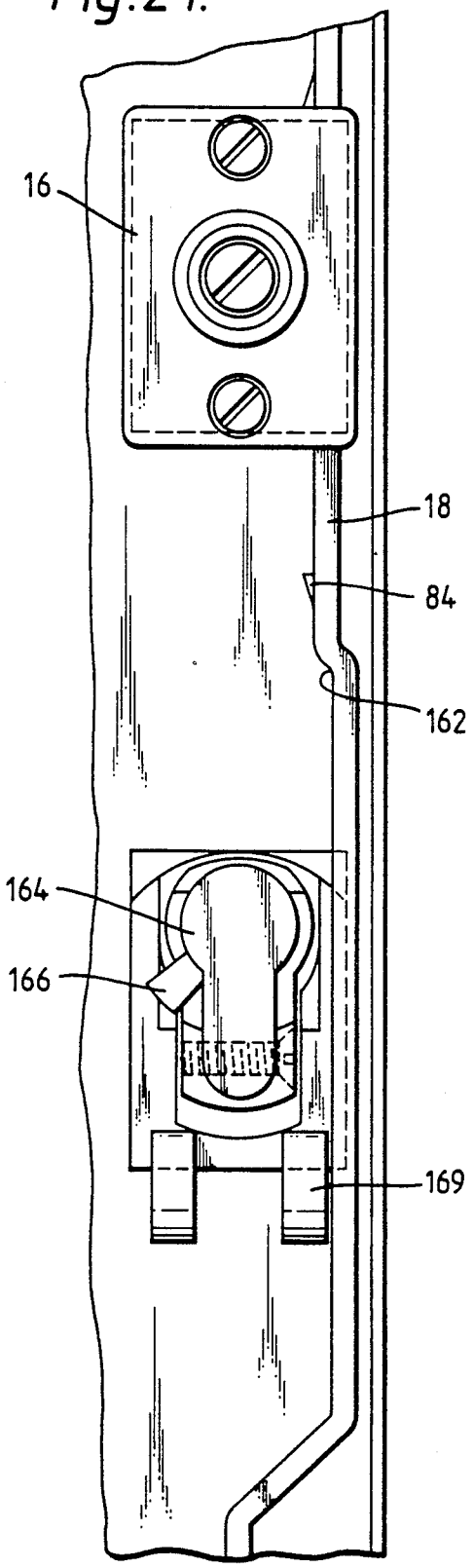
FIG. 21 shows a rear elevational view of the mounted pivot lever closure according to FIG. 4 as viewed from behind for representing an additional right angle-bend of the actuating bar in this application.
Figure 35:
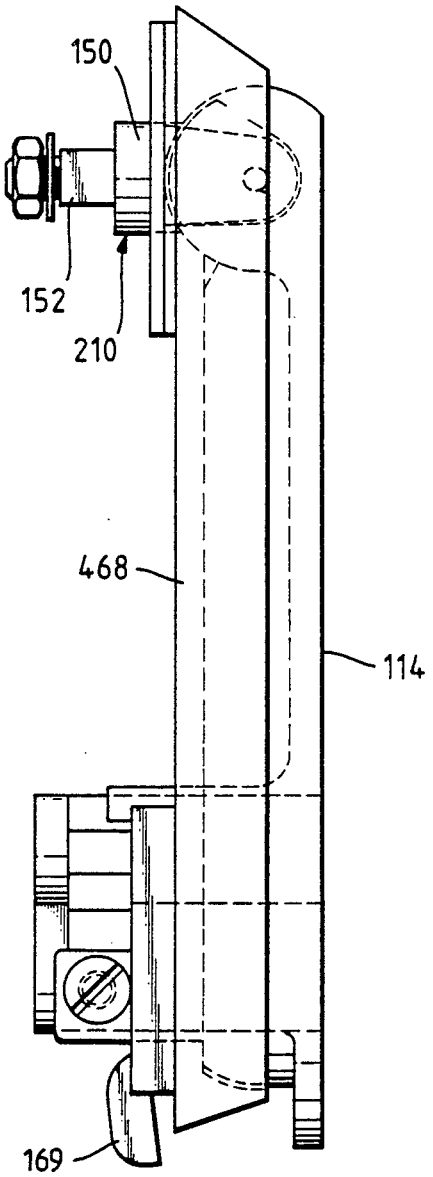
FIG. 35 shows an elevational side view of an assembled pivot lever according to the individual parts of FIGS. 19 A-D or 34 and 25 A-D.

FIG. 21 shows the pivot lever of FIG. 35 in the installed state from behind. Note should be made of an additional right angle-bend 162, which creates some additional space in the cylinder lock 164 of hand lever 114 (FIG. 36), if this is needed. Also the position of the thumb 166 displaced by 45° provides additional lateral space, which may be of advantage, given the narrow channel width here.

Of importance is further the hindgripping lug 169, which—due to its obliquity—permits, on the one hand, plugging in the base 468 obliquely with respect to the door panel 12, yet yields reliable clamping (jamming) when the base 468 is swivelled to the door panel plane.

Figure 37C:
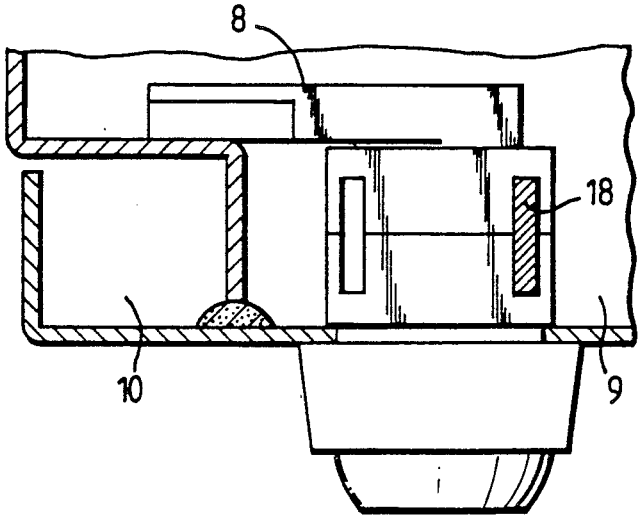
FIGS. 37 A-C show respectively front, bottom and side sectional views of a bar closure with sealable pivot lever actuation and wing tongue for installation outside the fillet gap and within the sealed cabinet space.
Figure 32A:
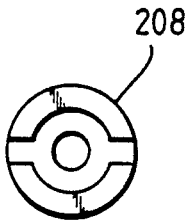
FIGS. 32 A,B show exploded views of embodiments respectively for a double bit closure and for a square closure.
Figure 32B:
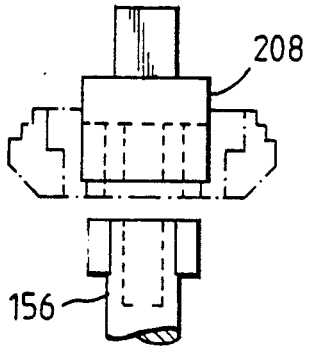
Figure 32C:
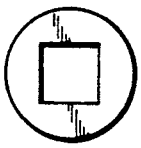
Figure 32D:
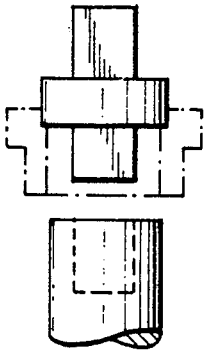
Figure 32E:
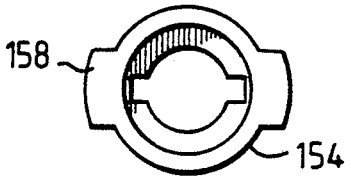
Figure 32F:
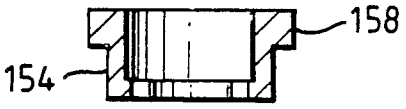
Figure 32G:
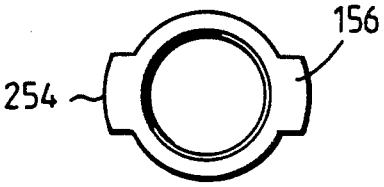
Figure 32H:
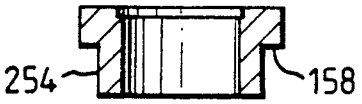
Figure 37B:
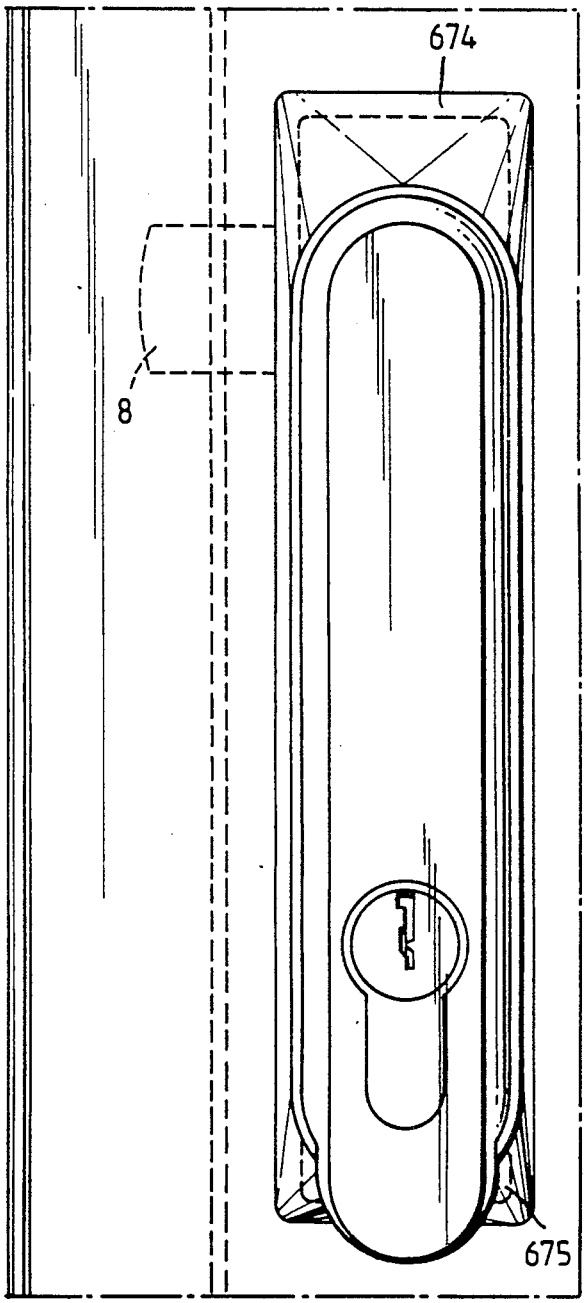
Figure 37A:
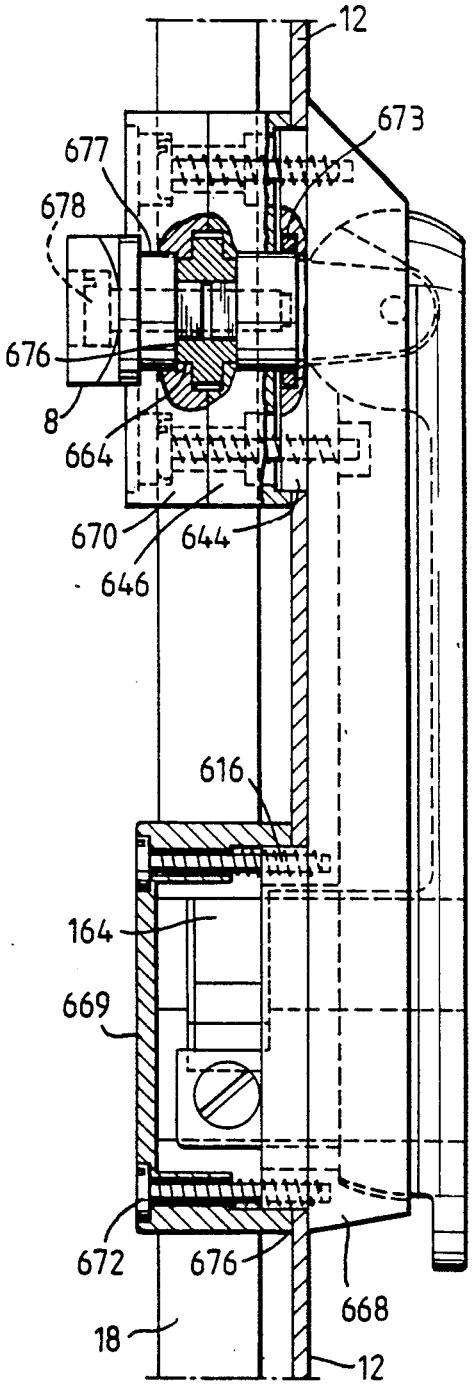

FIGS. 37A–C in a view from the front shows from top and in axial section a pivot lever actuation for the bar closure which has a base part 668, a cover cap 669 to encompass the cylinder 164, at the lower end. The cap 669 is fastened to the base part with screws 672 that can be screwed into corresponding bores 616 (can be seen similarly in FIGS. 16 A–D, see there reference number 516) of base part 668 of the upper region of the base part clamping in the door panel 12. An O-ring sealing 673 is located in an appropriate set-off. A sealing panel, which encompasses at least the areas 674, 675 surrounding apertures 32, 34, is placed between base part bearing surface and door panel the heads of the screws 672 are tightly enclosed. A sealing is provided between cap edge 676 and door panel. The closure can also be arranged outside the fillet gap 10 and within the sealed space 9, as shown in FIGS. 37A, without the closure endangering the space sealing.

In the installation method shown, use of a wing tongue 8 is possible. The lock nut 664 can be fashioned so that it has a contact face 676 with axial prismatic depression and a threaded bore for torsion-proof fastening a wing tongue 9. Such lock nut 664 can be composed of a pivot lever bearing similar to FIGS. 20 A–C and a pinion similar to FIGS. 31 A–D or 36 A–C and set into a lock case of parts similar to FIGS. 27 A–D and 28 A–D. The wing tongue 8 is provided with a shoulder 677 fastened with screw 678. The shoulder rests against the pinion and forms a pivot bearing surface in the lock case part 670.

In the case of symmetrical lock cases as in FIGS. 37 A–C, the lock nut 664 must be set back relatively wide with respect to the outer surface of the lock case, so that the pin does not project too far, as in the case of pin closures. Therefore, there is also the deep penetration of the wing tongue shoulder 677.

The described bar closure can be simply installed into the fillet gap of a sheet metal door because the bar guides 20 are clipped over the bars 18, the bar guides 20 are then set onto the stud bolts and screwed down with a nut (or alternatively are secured with screw bolt fastening). Then the base part 68 forming the key plate (possibly after inserting of appropriate supplemental parts such as pin insert 154, bearing part 146, and/or cover plate 188) is installed from the outside. The pinion 62 with the associated actuating pin for example, 208 in FIGS. 32 A, B, is inserted and then the cap part 70 is slipped over and the whole secured with the two screws 72. In this process, the switch panel door sheet is firmly clamped between the key plate or base part 68 and the slipped over part 70 and cover cap 669. The displacement forces transmitted from the bars onto the lock are taken up by the base part, not by a connection with a setscrew as is the case with prior art so that the danger of the safeguard loosening as in the prior art is not present.

Bar closures of the described nature are used in the electrical industry for locking switch cabinets made of sheet metal.

What is claimed is:

1. A bar for installation in at least one aperture of cabinet doors, comprising a lock with a lock nut supporting a pinion, and bearing means for rotatably supporting the lock nut, at least one bar having means for engaging teeth of the pinion and being displaceable longitudinally between non-locking and locking positions, locking elements which engage each other in response to the bar being in said locking position, said locking elements being free of each other when one bar is in the non-locking position, said bearing means comprising a base part and a cap part which is connectable with the base part, said cap part cooperating with the base part to form guiding slots for the bar, means for connecting said cap part and said base part together, said bar being removable together with said lock nut from said base part immediately after disconnecting said connecting means and removing said cap part, said bar being placeable back into said base part in any one of two different relative orientations, one of said two different relative orientations enabling the bar closure to be usable for right-opening cabinet doors and the other of said two different relative orientations enabling the bar closure to be usable for left-opening cabinet doors, said cap part being thereafter refastenable to said base part by said connecting means when said bar is in any of said two different relative positions.

2. A bar closure as stated in claim 1, wherein the cap part has a cap bottom from which two longer side walls extend parallel to the guiding slots and two shorter side walls are connected with one support and guide wall that projects into an interior of the cap part, said shorter guide walls being shorter than said longer guide walls and being arranged at a distance parallel to the longer side walls to form the guiding slots.

3. A bar closure as stated in claim 1, wherein the base part is in two parts and comprises a key catch part and a bearing part and that the bearing part of the base part and the cap part are of identical structure.

4. A bar closure as stated in claim 1, wherein on one of the base and cap parts, lugs project from a connection plane between the base and cap parts in a direction of the other of the base and cap parts, said lugs engaging corresponding setoffs of the other of the base and cap parts.

5. A bar closure as stated in claim 1, wherein the base part has projections for receiving a leaf spring which rests against a circumference of the lock nut.

6. A bar closure as stated in claim 5, wherein the circumference of the nut has flattened areas for receiving the leaf spring.

7. A bar closure as stated in claim 1, wherein the base part is part of a lever.

8. A bar closure as stated in claims 1, wherein the base part is part of a socket wrench.

9. A bar closure as stated in one of the claims 1, wherein the base part holds a cover plate for closing off another rectangular aperture.

10. A bar closure as stated in claim 1, wherein the lock nut has a bearing face with means for securing a wing tongue against deformation due to torsion.

11. A bar closure as stated in one of the claim 1, wherein the engaging portion of the bar comprises a predetermined number of apertures and the pinion comprises twice as many teeth of a flattened stopping face as there are said apertures for limiting the push-out path of the bar.

12. A bar closure for installation in at lest one aperture of a cabinet door, comprising:

a lock with a base portion, a cap portion and a lock nut between said base and cap portions, said lock nut being rotatable relative to said base and cap portions;

means for fastening said base portion and said cap portion together;

means for rotating said lock nut from outside said lock;

at least one displaceable bar engaging said lock nut through said base portion, said bar being displaceable between a non-locking position and a locking position in response to rotation of said lock nut;

locking elements which engage each other in response to said bar being in said locking position for locking the cabinet door, said locking elements being free of engagement with each other in response to said bar being in said non-locking position for unlocking the cabinet door, said bar being removable together with said lock nut from said base portion immediately after unfastening said fastening means and removing said cap portion, said bar being placeable back into said base portion in any one of two different relative orientations, one of said two different relative orientations enabling the bar closure to be usable for right-opening cabinet doors, the other of said two different relative orientations enabling the bar closure to be usable for left-opening cabinet doors, said cap portion being refastenable to said base portion by said fastening means when said bar is in any of said two different relative orientations.

* * * * *